US006069355A

United States Patent [19]

Mordehai

[11] Patent Number: 6,069,355

[45] Date of Patent: May 30, 2000

[54] ION TRAP MASS PECTROMETER WITH ELECTROSPRAY IONIZATION

[75] Inventor: Alexander Mordehai, Mountain View, Calif.

[73] Assignee: Varian, Inc., Palo Alto, Calif.

[21] Appl. No.: 09/079,110

[22] Filed: May 14, 1998

[51] Int. Cl.[7] ..... H01J 49/00

[52] U.S. Cl. ..... 250/281; 250/289; 250/292

[58] Field of Search ..... 250/281, 287, 250/289, 292

[56] References Cited

U.S. PATENT DOCUMENTS

| | | | |
|---|---|---|---|
| 5,179,278 | 1/1993 | Douglas | 250/290 |
| 5,268,572 | 12/1993 | Mordehai et al. | 250/289 |
| 5,352,892 | 10/1994 | Mordehai et al. | 250/288 |
| 5,652,427 | 7/1997 | Whitehouse et al. | 250/288 |
| 5,750,993 | 5/1998 | Bier | 250/292 |

FOREIGN PATENT DOCUMENTS

97/07530 2/1997 WIPO .

OTHER PUBLICATIONS

Article by Van Berkel et al., entitled "Electrospray Ionization Combined with Ion Trap Mass Spectrometry," published in *Anal. Chem.* in 1990, in vol. 62, pp. 1284–1295.

Article entitled "Introducing LCQ . . . The Power of MS," published in *Analytical News*, Summer 1995.

Article entiled "the Esauire–LC Ion Trap LC/MS$^{(n)}$ System," published in *Bruker/Hewlett–Packard*, Copyright 1997.

Article by Douglas et al., entitled "Collisional Focusing Effects in Radio Frequency Quadrupoles," published in *American Society for Mass spectrometry* in 1992, in vol. 3, pp. 398–408.

*Primary Examiner*—Kiet T. Nguyen

*Attorney, Agent, or Firm*—Bella Fishman

[57] ABSTRACT

A mass spectrometer system with electrospray ion source for generating ions at atmospheric pressure and an ion trap mass analyzer has an improved ion optics for transporting ions from the atmospheric pressure region to the ion trap mass analyzer region. The system comprises a short ion guide having a predetermined characteristic length to radius ratio. The ion guide is coupled to the ion trap mass analyzer via an electrostatic ion optics. The electrostatic ion optics comprises an ion guide extraction optics and an ion trap mass analyzer injection optics. The ion guide extraction optics comprises the ion optical electrode with an aperture that is coupled to an exit of the ion guide and serves as a differential pressure restrictor between the vacuum chamber with the ion guide and the vacuum chamber with the ion trap mass analyzer. The design of the ion optics is tolerant to the mechanical imperfections in the ion optical system and practically eliminates the non-linear matrix effects.

15 Claims, 4 Drawing Sheets

ION TRAP MASS PECTROMETER WITH ELECTROSPRAY IONIZATION

FIELD OF THE INVENTION

This invention relates to the ion trap (IT) mass spectrometer systems with electrospray ionization. More particularly, it relates to a mass spectrometer system having an ion guide and an ion trap mass analyzer.

BACKGROUND OF THE INVENTION

Atmospheric pressure ionization and, in particular, the combination of electrospray ionization with ion trap mass analyzers has become an extremely powerful analytical technique for organic and biochemical analyses. This technique was originated at Oak Ridge National Laboratories (G. J. Van Berkel, S. A. McLukey and G. L. Glish, Anal. Chem., v.62, 1284, 1990).

An improved ion sampling interface with pure electrostatic ion optics for the ion trap mass analyzer was developed later and claimed in the U.S. Pat. No. 5,352,892 and the U.S. Pat. No. 5,268,572. Both designs described in these patents comprise oversized vacuum systems and have a relatively low sensitivity for the size of the utilized vacuum pumps.

Lately, it was established that quadruple ion guides can be a very efficient means for ion transportation through the intermediate pressure range ($10^{-1}$–$10^{-4}$ Torr) (D. J. Douglas and J. B. French, J.Am.Soc. Mass. Spectrom., 1992, 3, 398–408). The quadruple ion guide as an ion transportation means was used in several designs. For example, G. Whitehouse (the U.S. Pat. No. 5,652,427) describes a mass spectrometer system with a long ion guide penetrating two differentially pumped vacuum chambers for separating ions from neutrals and interfacing the ion trap mass analyzer chamber. To achieve the desirable differential pumping ratio between chambers the length of the ion guide has to be sufficient to provide appropriate attenuation in the gas load. There are several disadvantages associated with this approach including the effect of ion accumulation in the long ion guides. The ion accumulation within the ion guide results in non-linear ion signal response as well as matrix effects (WO 97/07530).

In yet another designs (the U.S. Pat. No. 5,179,278) the ion guide was placed before the ion trap mass analyzer as an accumulative device with a specially designed pulsed ion optics to improve the duty cycle for the ion trap. This system was very complex, and the design of ion optics may produce matrix effects.

LCQ instrument manufactured by Finnigan Inc incorporates two short ion guides separated with a restricting element in between. The differential pumping ratio was improved in this design and no matrix effects were reported, however the direct coupling of the ion guide to the ion trap resulted in decreased sensitivity. In Esquire instrument manufactured by Bruker/Hewlett-Packard pair of short ion guides were used in conjunction with two additional electrostatic lenses just in front of the ion trap mass analyzer. That configuration solves most of the problems associated with previous designs, however, it is more complex, expensive and the differential pumping ratio is not improved substantially compare to the prior art systems.

Accordingly, it is desirable to provide a mass spectrometer system with improved ion transportation from the atmospheric pressure region to the ion trap mass analyzer vacuum region and decreased pumping load.

SUMMARY OF THE INVENTION

According to the present invention, the mass spectrometer system comprises an electrospray ion source for generating ions at atmospheric pressure, and three connected in sequence vacuum chambers with three respective vacuum pressure regions. A first vacuum chamber is adjacent to the electrospray ion source and connected to a second vacuum chamber via a differential pressure restrictor with an opening. The second vacuum chamber is connected to a third vacuum chamber via an ion optical electrode having an aperture. An ion sampling device is positioned in the first chamber for delivering ions to the first and second chambers. The second chamber comprises a short ion guide for passing the ions to the third vacuum chamber. The third vacuum chamber comprises electrostatic ion optics for passing ions therethrough and focusing them into the ion trap mass analyzer. The electrostatic ion optics comprises an ion guide extraction optics and an ion trap mass analyzer injection optics. The ion guide extraction optics comprises the ion optical electrode with an aperture that is coupled to an exit of the ion guide and serves as a differential pressure restrictor between the second and third vacuum chambers. The ion guide has a length of L and characteristic radius of $r_0$, wherein the ratio of length to characteristic radius ($L/r_0$) should not exceed 50 to avoid ion accumulation inside the ion guide, and should not be less than 15 to be sufficient to provide collisional focusing for the ions of mass to charge ratio within a mass analyzer range.

According to one embodiment of the present invention, the electrostatic ion optics comprises ion guide extraction optics and ion trap injection optics, wherein the ion guide extraction optics is formed by the ion optical electrode and a refocusing lens, and ion trap injection optics is formed by a pair of lenses electrodes that are coaxial to the main axis of the ion trap mass analyzer and mounted to the ion trap mass analyzer's body.

According to the other embodiment of the present invention, the electrostatic ion optics comprises a tube lens having a body with a plurality of openings for pumping out neutrals.

DETAILED DESCRIPTION OF THE PREFERRED EMBODIMENTS

Figure 1:
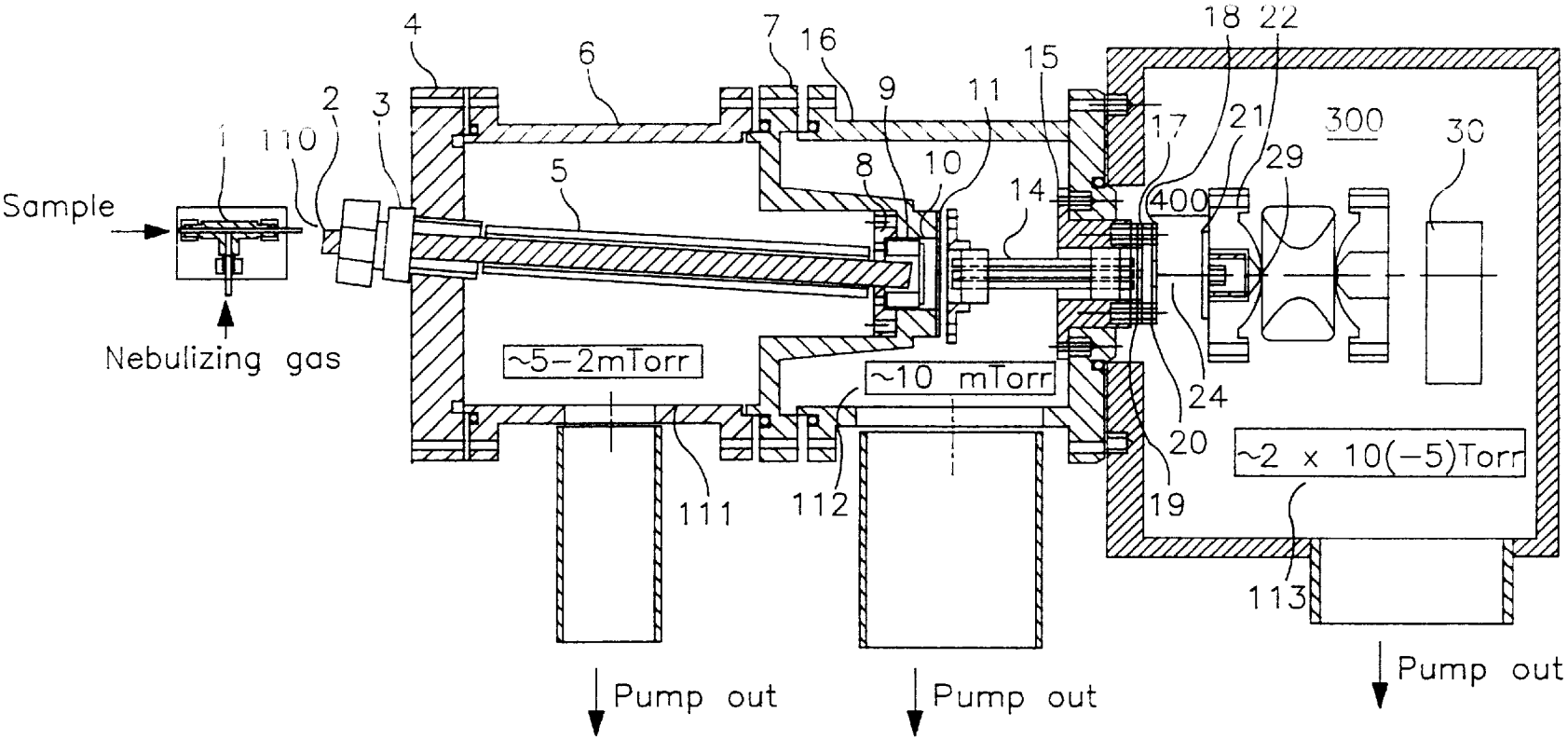
FIG. 1 is a schematic illustration of the ion trap mass spectrometer system for electrospray ionization according to the present invention.

FIG. 1 shows a schematic illustration of the preferred embodiment for the ion trap mass spectrometer with atmospheric pressure ionization according to the present invention. The system comprises electrospray nebulizer 1 positioned within atmospheric pressure region 110 and ion-sampling interface 200 defined by two vacuum chambers 6 and 16 with two respective vacuum regions of differential pumping 111 and 112. The detailed description of the ion-sampling interface is given in the U.S. Pat. No. 5,672,868 assigned to the Assignee of the present invention. The system further comprises a third vacuum chamber having ion trap mass analyzer 300 within ion trap mass analyzer vacuum region 113 and electrostatic ion optics 400 which is disposed between ion trap mass analyzer 300 and ion sampling interface 200.

According to the present invention ions are formed at atmospheric pressure in region 110, by, for example, electrospray ionization using electrospray nebulizer 1. The electrospary nebulizer may be a pneumatically assisted sprayer. The produced ions are sampled into a first differential vacuum pumping region 111 through ion sampling capillary 2 which is heated by electrical heater 5. Ion sampling capillary 2 is electrically isolated from front flange 4 with insulating union 3 and is positioned in a way to transfer ions into a second differential vacuum pumping region 112. The first and second differential pumping regions are separated by differential pressure restricotor 11. Focusing lens 10 is mounted on intermediate flange 7 with two spacers 9, which are attached to centering bracket 8. Focusing lens 10 and differential pressure restrictor 11 are concentricity aligned. Electrical potentials are applied to the ion sampling capillary 2, focusing lens 10 and differential pressure restrictor 11 to provide efficient ion transportation to ion guide 14 of second vacuum region 112 within chamber 16. Ion guide 14 is secured to intermediate flange 7 by centering holder 12 and ion guide exit holder 15.

In the preferred embodiment the ion guide is a hexapole. According to the present invention, the aspect ratio ($L/r_0$) for the ion guide of length L and the characteristic radius $r_0$ is preferably selected in a range from 15 to 50.

The value of the aspect ratio should be preferably within an upper limit to avoid accumulation of ions transporting through the intermediate pressure region within this ion guide. The efficient transport of ions through the ion guide can be achieved by creating a sufficiently strong axial electrostatic field component along the whole length of the short ion guide due to the propagation of the electric fields therein from differential pressure restrictor 11 and ion guide extraction lens 17. Differential pressure restrictor 11 and ion guide extraction lens 17 are biased by predetermined voltages with respect to ion guide 14 to create axial electrical field in a direction of ion tap mass analyzer 300. These voltages are adjusted so that optimum ion transport efficiency can be achieved and are typicality in the range ±200 V.

The aspect ratio at its low value limit is generally defined by practical considerations such as providing adequate space within the ion guide for effective pumping. Ion guide's length L should be sufficient to provide a collisional focusing effect, which is beneficial for effective ion transport (D. J. Douglas and J. B. French, J. Am.Soc. Mass. Spectrom., 1992,3, 398–408).

The ions being produced by electrospray ionization in the atmospheric pressure region are sampled into the differentially pumped vacuum regions. The sampled ions have a broad spectrum of kinetic energies. When transported through the ion guide these ions experience numerous collisions with molecules of the background gas resulting in substantial kinetic energy dissipation. This effect improves ion transportation compare to the systems without radio frequency ion guides. The length of the ion guide should be sufficient to provide multiple ion collisions for achieving collisional focusing. The theory of collisional focusing is disclosed by Tolmachev, et al "A Collisional Focusing Ion Guide for Coupling an Atmospheric Pressure Ion Source to a Mass Spectrometer", Nuclear Instruments and Methods in Physics Research B, 1997, 124, 112–119, and by Loboda, et al "New Method for Ion Mobility Determination by Stability Threshold Measurement in Gas Filled Radio Frequency Quadrupoles", Rapid Communications in Mass Spectrometry, 1998, 12, 45–49.

To evaluate the minimum ion guide length for achieving the collisional focusing it is sufficient to consider collisions between neutrals and ions within hard-sphere model. According to that model an ion-neutral collision results in the decreased ion kinetic energy, E by value, ΔE, which is defined by the equation:

$$\Delta E/E=2\ m/(m+M) \tag{1}$$

where m is mass of the background gas inside the ion guide (for example, air has effective m=29 amu) and M is the mass of the analyzed ions within the mass range restricted by the mass range of the ion trap mass analyzer.

The mean free path for the ions is given by:

$$L_m=1/n\sigma \tag{2}$$

where n is the density of the background gas and a is the collisional crossection.

To achieve the collisional cooling effect an ion should experience multiple collisions with background gas, slowly loosing kinetic energy by ΔE for each collision. The total effective collisional length $L_c$ before an ion will loose a substantial fraction of its initial energy $E_o$ can be evaluated from the following equation:

$$L_c/L_m=E/\Delta E \tag{3}$$

Combining equations 1,2 and 3 one obtains:

$$L_c=(M+m)/(2\ mn\sigma) \tag{4}$$

The length of the ion guide length L should exceed the effective collisional length $L_c$ to achieve effective collisional cooling within the ion guide. This condition can be expressed in more practical form by converting density of the background gas (air) into pressure and taking into account several facts: first is that for the electrospray ion sources M>>m and second that the ratio M/σ is substantially constant (~4 aum/$A^2$) for the broad range of different protein ions (T. Covey and D. J. Douglas "Collision Cross Sections for Protein Ions", J Am.Soc. Mass Spectrum 1993, 4, 616–623.):

$$L>2S/P \tag{5}$$

where the ion guide length, L, is in (cm) and background pressure, P, is in (mTorr). For the typical value of 10 mtor for the background pressure of air within the ion guide one obtains that ion guide length, L should exceed 2.5 cm (1" at 10 mTorr) to achieve collisional focusing effect.

The ion guide used in the preferred embodiment of the present invention had $r_0$=2 mm and L=65 mm resulting in aspect ratio of 32 that satisfies the requirement of equation (5) for the collisional cooling. Due to the extraction field created by ion guide extraction lens 17 ions exit the ion guide. Lens 17 is sealed with O-ring 19 and is mounted directly on hexapole centering holder 15. The central opening in ion guide extraction lens 17 is about 2 mm in diameter to provide high differential pumping ratio between the second vacuum region 112 and ion trap mass analyzer vacuum region 113.

The ion guides of the prior art systems that penetrate the differentially pumped vacuum chambers should be substantially longer than the ion guide of the present invention for achieving the same differential-pumping ratio. For example, in the system disclosed in the U.S. Pat. No. 5,652,427, to obtain the differential pumping ratio equals the differential pumping ratio of the system of the present invention, the length of the ion guide should be about 140 mm. The ion guide of this length causes ions accumulation inside the ion guide, matrix effects, non-linear quantitization calibration curves and bulky instrument design.

The ion beam extracted from ion guide 14 by lens 17 is diverging, and lens 18 is used to refocus it to the ion beam being substantially parallel to a main axis of ion guide 14. Lens 18 is mounted preferably on hexapole holder 15, which is separated with isolating spacers 19 from extraction lens 17. The ion guide, the extraction lens and the refocusing lens are mounted on the common base, i.e. ion guide exit holder 15, and therefor their mutual centering is easily achieved. Lenses 21 and 22 are mounted directly on the body of the ion trap mass analyzer and are aligned with ion trap mass analyzer entrance aperture 29. Lens 22 serves as the ion injection lens while lens 21 provides a shielding to separate ion injection and ion transport regions. The substantially parallel ion beam obtained within the ion transport region 24 propagates directly to an entrance of the injection optics of the ion trap mass analyzer. As a result, mechanical tolerance requirements diminish substantially for the positioning of the ion trap mass analyzer with respect to the central axis of the ion guide. This feature is essential in the commercial production where a good reproducibility can be achieved within the production line without implementing extra tight mechanical tolerances.

After ion beam is injected into the ion trap mass analyzer standard techniques can be used to manipulate and analyze ions. External electron multiplier detector 30 provides ion detection. (R. E. March and Hudhes, Quadruple Storage Mass Spectrometry, John Wiley and Sons, NY, 1984)

To evaluate the sensitivity of the system of the present invention a continues infusion analysis of one of the organic ammonium salts (tetraoctyl ammonium bromide, m/z=466) has been performed. This sample is widely used in the electrospray mass spectrometry for tuning. The sample concentration was 1 pmol/$\mu$l dissolved in 80/20 methanol/water, which was delivered with infusion rate of 10 $\mu$l/min. The elelctrospray neubelizer was maintained at 3.5 kV and was operated with air nebulazing gas at 50 psi.

The first vacuum region was pumped with SD 450 (300 l/min) mechanical pump, the second vacuum region was pumped with V-70LP (70 l/s) turbo pump and the ion trap region was pumped with V-250 (250 l/s) turbo pump manufactured by Varian Associates Inc. The ion trap mass analyzer was filled with the He buffer gas at the pressure of about $10^{-3}$ Torr.

The specific potentials were applied to transfer sampling capillary 2 (+65V), to focusing lens 10 (+90 V), to differential pressure restrictor 11 (+18V), to ion guide 14 (DC bias voltage +12V, RF voltage 300Vp-p at 1 MHz), to ion guide extraction lens 17 (−60V), to focusing lens 18 (+10V), to lens 21(+6V) and to lens 22 (−20V) to achieve optimal ion transmission. The potential at differential pressure restrictor 11 was pulsed to the stopping potential of about +200V to gate the ion beam.

Figure 2:
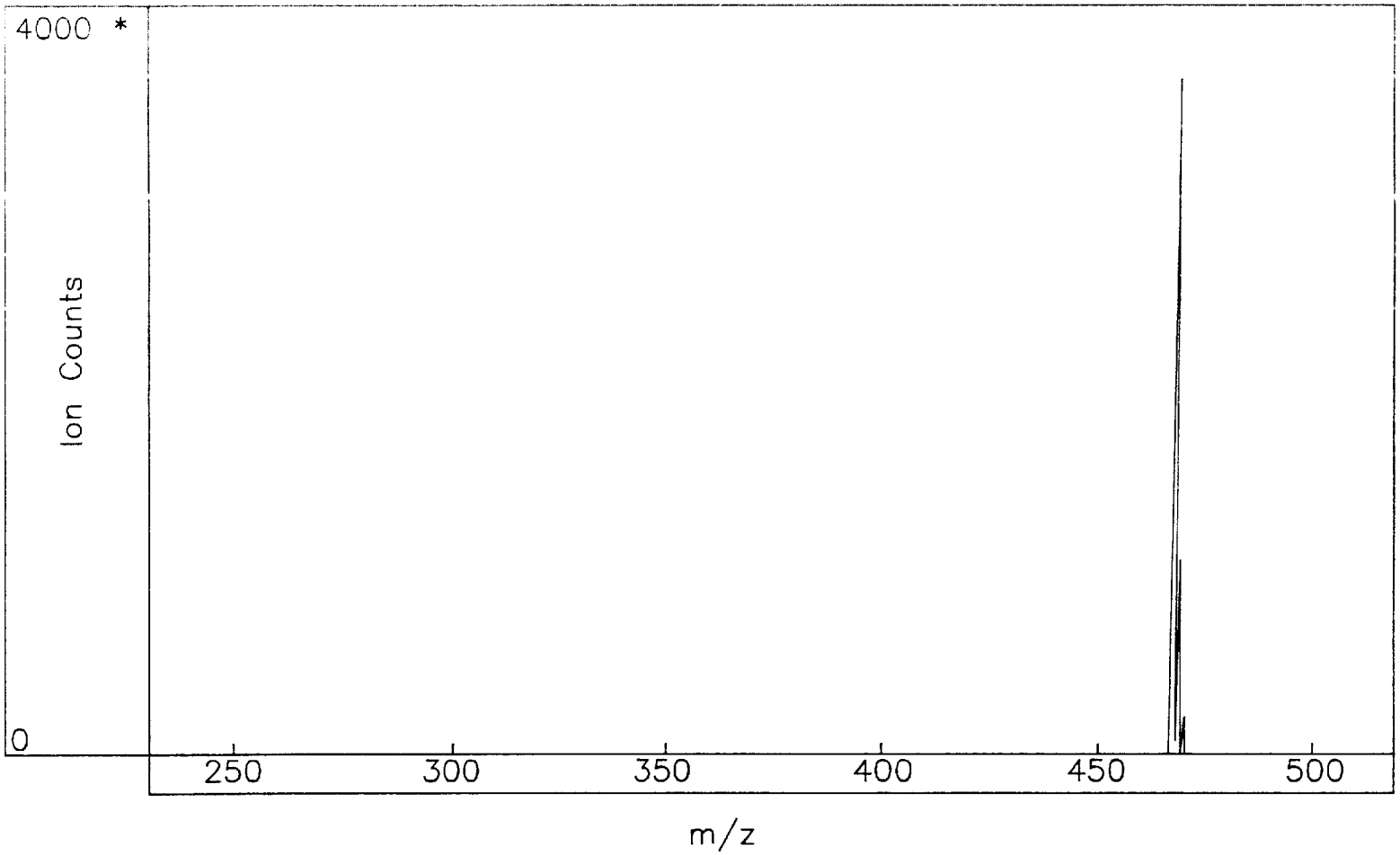
FIG. 2 shows a mass spectrum of a tetraoctyl ammonium bromide, obtained in the infusion experiment at 1 pMol/$\mu$l concentration utilizing the ion trap mass spectrometer system of the present invention.

FIG. 2. shows the mass spectrum with typical molecular ion isotopic pattern at m/z=466. The isotopic pattern in the mass spectrum has four peaks, which are corresponding to molecules containing zero, one, two and three $C^{13}$ atoms respectively. This mass spectrum is the result of 10 single scan averages with ion accumulation time of 10 ms per each scan. The total amount of the consumed sample is about 16 fmol. Three largest isotopic peaks are well observable above the background line, so it is possible to evaluate the amount of the consumed sample per isotopic peak. The main peak, for molecular ion without $C^{13}$ atoms, corresponds to 11 fMol of the consumed sample; the M+1 peak, with one $C^{13}$ atom, corresponds to 4 fMol and the M+2 peak, with two $C^{13}$ atoms, corresponds to 0.7 fMol. These data demonstrate low femtomole sensitivity for the system of present invention.

Figure 3:
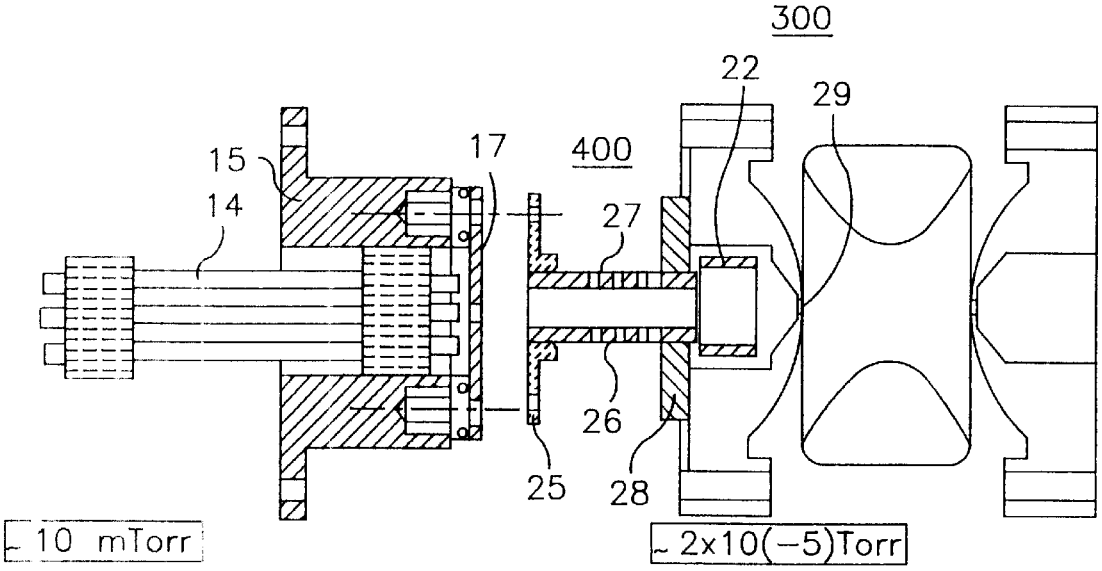
FIG. 3 is a schematic illustration of the ion guide and the ion trap mass analyzer with the electrostatic optics therebetween according to one embodiment of the present invention.
Figure 4:
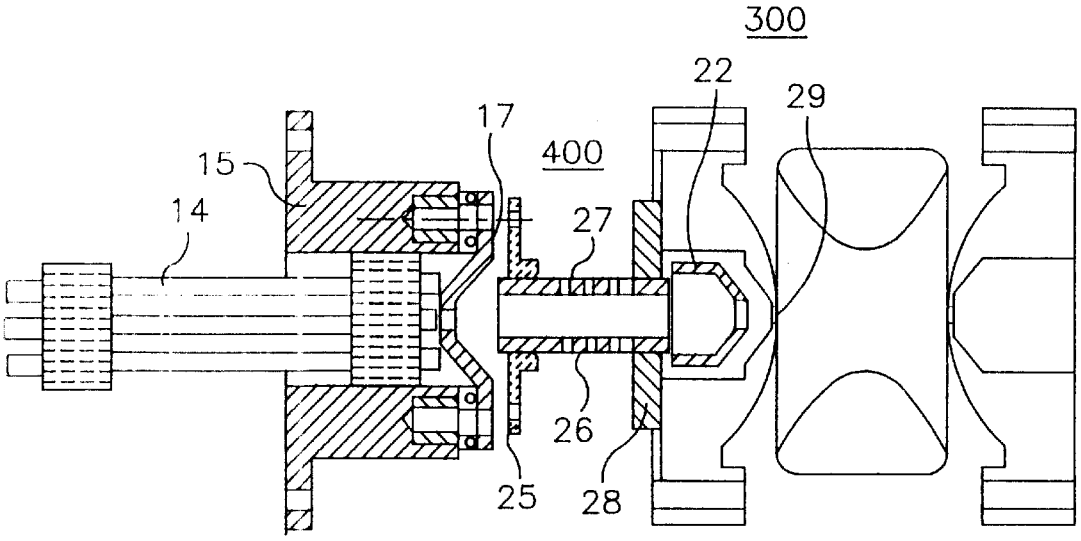
FIG. 4 a schematic illustration of the ion guide and the ion trap mass analyzer with the electrostatic optics therebetween according to the other embodiment of the present invention

There are several alternative embodiments of the present invention utilizing the combination of a short ion guide located in the second vacuum region with different arrangements of electrostatic ion optics in the mass analyzer region as shown in FIG. 3 and FIG. 4. The four-element electrostatic ion optics can be simplified by utilizing tube lens 26 as shown in FIG. 3 and FIG. 4. Different mounting arrangements can be provided to secure ion optical elements in place. Tube lens 26 can be mounted via guiding union 28 directly to the ion trap mass analyzer assembly 300 and secured in place from the opposite side by entrance union 25 which is mounted directly on ion guide exit holder 15. In this configuration tube lens 26 is well aligned with the ion guide exit and the ion trap mass analyzer entrance aperture. Tube lens 26 can be perforated to provide openings 27 for better pumping.

According to one of the embodiments of the present invention ion extraction lens 17 and ion injection lens 22 can be made conical as shown in FIG. 4. The conical lens 22 delivers the stronger electrical field to ion trap mass analyzer entrance aperture 29, thus providing further improvements in the total ion transmission.

Although the invention has been described with a certain degree of particularity, it is understood that the present disclosure of the preferred embodiments has been made only by way of examples. It is possible to use different ion sampling devices to collect ions from the atmospheric pressure region. A nozzle ion sampling device can be utilize instead of the sampling capillary as well as atmospheric pressure chemical ionization ion source can be utilize instead of elelectrospray ion source. Other changes in the elements and their mutual placement of the mass spectrometer system may be made without departing from the spirit and the scope of the invention.

What is claimed is:

1. An ion trap mass spectrometer system with electrospray ionization comprising:

an electrospray ion source for generating ions at atmospheric pressure;

a first, a second and a third vacuum chambers connected in sequence therebetween for passing said ions therethrough, said first vacuum chamber being adjacent to said electrospray ion source;

a sampling device positioned within said first chamber for delivering the ions to said first and second vacuum chambers;

an ion guide positioned within said second chamber for passing the ions from said second vacuum chamber to said third vacuum chamber; and an electrostatic ion optics and ion trap mass analyzer positioned within said third chamber for passing said ions through said electrostatic ion optics and focusing said ions into said ion trap, said electrostatic optics comprising an ion guide extraction optics and an ion trap mass analyzer injection optics, said ion guide extraction optics comprising an ion optical electrode having an aperture and coupled to an exit of said ion guide, said optical electrode being a differential pressure restrictor between said second and third chambers.

2. The ion trap mass spectrometer system of claim 1, further comprising a differential pressure restrictor mounted between said first and second vacuum chambers, said restrictor has an orifice.

3. The ion trap mass spectrometer system of claim 2, wherein said ion guide has a length of L and a characteristic radius of $r_0$, whereby the length to radius characteristic ratio of $L/r_0$ equals a value in a range from about 15 to about 50.

4. The ion trap mass spectrometer system of claim 3, wherein said ion guide extraction optics further comprising at least a pair of spaced apart lens electrodes.

5. The ion trap mass spectrometer system of claim 4, wherein said ion guide extraction optics is coaxial to a main axis of said ion guide and is positioned at an exit thereto.

6. The ion trap mass spectrometer system of claim 5, wherein said ion trap mass analyzer injection optics is mounted to a body of said ion trap.

7. The ion trap mass spectrometer system of claim 6, wherein said ion trap mass analyzer injection optics is formed by at least one lens electrode adjacent to an entrance ion trap mass analyzer aperture.

8. The ion trap mass spectrometer system of claim 6, wherein said ion trap mass analyzer injection optics is formed by a pair of lens electrodes that are coaxial to the main axis of said ion trap mass analyzer.

9. The ion trap mass spectrometer system of claim 3, wherein said ion trap mass analyzer injection optics comprises a plurality of lens electrodes that are positioned coaxial to a main axis of said ion trap for receiving extracted ions from said extraction ion optics, refocusing said extracted ions and passing said ion beam towards said ion trap.

10. The ion trap mass spectrometer system of claim 9, wherein a respective independently adjusted potential is applied to each lens electrode of said plurality.

11. The ion trap mass spectrometer system of claim 3, wherein said electrostatic ion optics comprises two pairs of lens electrodes, one pair of said lens electrodes is mounted to an exit of said ion guide and the other pair of said lens electrodes is mounted to an entrance of said ion trap mass analyzer.

12. The ion trap mass spectrometer system of claim 3, wherein said electrostatic ion optics comprises tube lens electrode having a body with a plurality of openings for pumping out neutrals, said tube lens electrode is connected by a first end to an exit of said ion guide and by a second end to an entrance of said ion trap mass analyzer.

13. The ion trap mass spectrometer system of claim 12, wherein said electrostatic ion optics further comprising a lens electrode mounted to said ion trap mass analyzer, and forming with said optical electrode and said tube lens electrode has a three-element electrostatic ion optics, wherein an independently adjustable potential is applied to each said electrode.

14. An ion trap mass spectrometer system comprising:

an atmospheric pressure ionization ion source for generating ions;

a plurality of sequentially connected vacuum chambers having a progressively reduced pressure in each chamber of said plurality for passing said ions therethrough;

an ion guide positioned within an ion guide vacuum chamber of said plurality, a longitudinal dimension of said ion guide being comparable with collision focusing length of said ions; and an electrostatic ion optics positioned within an ion trap mass analyzer vacuum chamber, said ion trap mass analyzer vacuum chamber being adjacent to said ion guide vacuum chamber, said electrostatic ion optics comprising an ion guide extraction optics and an ion trap mass analyzer injection optics, said ion guide extraction optics comprising an optical electrode having an aperture and coupled to an exit of said ion guide, said optical electrode being a differential pressure restrictor between said ion guide vacuum chamber and ion trap mass analyzer chamber.

15. The ion trap mass spectrometer system of claim 14, wherein said ion guide vacuum chamber is pumped to the pressure in a range from $1–10^{-4}$ Torr.

* * * * *

UNITED STATES PATENT AND TRADEMARK OFFICE

CERTIFICATE OF CORRECTION

PATENT NO. : 6,069,355
DATED : May 30, 2000
INVENTOR(S) : Alexander Mordehai

It is certified that error appears in the above-identified patent and that said Letters Patent is hereby corrected as shown below:

Title,
Item [54] change "ION TRAP MASS PECTROMETER WITH ELECTROSPRAY IONIZATION" to -- ION TRAP MASS SPECTROMETER WITH ELECTROSPRAY IONIZATION --

Signed and Sealed this

Twenty-first Day of August, 2001

*Attest:*

Nicholas P. Godici

NICHOLAS P. GODICI
*Acting Director of the United States Patent and Trademark Office*

*Attesting Officer*